United States Patent [19]

Hallqvist

[11] Patent Number: 4,730,539

[45] Date of Patent: Mar. 15, 1988

[54] APPARATUS FOR INCREASING THE RATE OF FIRE IN AUTOMATIC WEAPONS

[75] Inventor: Sten Hallqvist, Karlskoga, Sweden

[73] Assignee: Aktiebolaget Bofors, Bofors, Sweden

[21] Appl. No.: 855,580

[22] Filed: Apr. 25, 1986

[30] Foreign Application Priority Data

Apr. 26, 1985 [SE] Sweden ..... 8502020

[51] Int. Cl.[4] ..... F41D 10/10

[52] U.S. Cl. ..... 89/167; 89/24; 89/198

[58] Field of Search ..... 89/164, 167, 186, 198, 89/24, 4.2; 42/25

[56] References Cited

U.S. PATENT DOCUMENTS

| | | | |
|---|---|---|---|
| 1,750,724 | 3/1930 | Methlin | 89/167 |
| 1,805,601 | 5/1931 | Ross | 89/186 |
| 2,600,007 | 7/1952 | Lippert | 42/70.01 |
| 2,613,576 | 10/1952 | Finn | 42/25 |
| 3,656,400 | 8/1972 | Stoner et al. | 89/198 |

FOREIGN PATENT DOCUMENTS

| | | | |
|---|---|---|---|
| 1255921 | 12/1971 | United Kingdom | 89/167 |

*Primary Examiner*—Stephen C. Bentley
*Assistant Examiner*—Stephen M. Johnson
*Attorney, Agent, or Firm*—Pollock, Van Sande & Priddy

[57] ABSTRACT

An automatic weapon is provided with a device for increasing the rate of fire. The breech mechanism of the weapon is controlled by means of recoil movements which arise on discharge of the weapon, and by an operating cam and spring member included in the breech mechanism. Two case ejectors are disposed for arresting the breech block in the total recoil position of the breech and holding the breech block in the open position for ramming-home of a new round. In the arrested position of the breech block, the ejectors are exposable to the new round during its ramming cycle. A portion of the kinetic energy inherent in the round is transmitted to the ejectors which, may accompany the round and release the breech block for actuation by the spring member towards its closed position. The operating cam is movably disposed at least when the breech is located in the total recoil position. The spring member begins to actuate the breech block on its movement towards the arrest position at an earlier stage than total recoil position.

6 Claims, 4 Drawing Figures

APPARATUS FOR INCREASING THE RATE OF FIRE IN AUTOMATIC WEAPONS

TECHNICAL FIELD

The present invention relates to an apparatus for increasing the rate of fire in an automatic weapon, including a breech block and an associated mechanism for guiding the breech block. The breech mechanism is controlled by means of the recoil movements generated in the weapon on discharge and by means of an operating cam and spring means included in the mechanism. The latter includes case ejectors (extractors) which are disposed to arrest the breech block in the region of full recoil of the breech and to hold the block in its opened position so as to make for the subsequent ramming (or homing) of a new round. The above-mentioned case ejectors are also disposed, in the arrested position of the breech block, to be exposable to the new round during its feeding and ramming cycle so that the ejectors may be entrained with the round and thereby release the breech block so that it become unrestrained to be actuated by spring means towards its closed position. The actuation of the breech block from fully open position towards its closure position is also realized as a result of the circumstance that the breech block, in its fully open position, strikes against an abutment surface on the case ejector, an upward movement being thereby imparted to the breech block.

THE STATE OF THE ART

In a 40 mm automatic gun for example, power to the breech mechanism derives from the recoil generated on discharge of the piece. In the firing position, the breech block is held closed by spring means. The ejectors are in engagement with the rear edge of the cartridge case of the round. During a recoil, the breech block is forced to open position against the action of the spring means. During that part of the opening movement of the breech block when the cartridge case is rearwardly exposed, the breech block acts mechanically on the ejectors so that these may execute their ejection movements. On recuperation of the breech after executed recoil, the breech block is urged towards its closed position by the spring means. However, the breech block is arrested by the ejectors and is thereby prevented from executing its closure movement. A subsequent ramming of a new round is to entail that the rear edge of the new cartridge case enters into engagement with the ejectors which, by means of the inherent ramming impetus in the round, may be released from the breech block, whereafter the latter, as a result of impact against the abutment surface of each respective case ejector, and by the action of the spring means, is forced to its closure position, and so on.

This function is realized in a manner known in the art by means of an operating shaft which is provided with an operating arm and operating linkages. The operating arm acts upon the breech block by the intermediary of the operating linkages and determines the movements of the breech block in dependence upon the torque which is imparted thereto from an operating cam via the operating arm and from the spring means with which the arm cooperates.

SUMMARY OF THE INVENTION

1. TECHNICAL PROBLEM

This function is based on the knowledge that the operating arm can execute a movement in relation to the operating cam. This problem has hitherto been solved such that the operating cam is fixedly journalled in the breech casing.

However, in the types of automatic guns contemplated here, it is of critical importance to be able to attain the highest possible rate of fire. To achieve a rapid loading cycle, one of the factors which is of decisive importance is how quickly the ramming of each respective round can be commenced.

The prior art operating cam arrangements have suffered from the drawback of a delay in the arrest cycle of the breech proper. The breech block, which is dependent upon the rotational movements of the operating arm, cannot start its movement into the arrest position until the breech has executed a certain movement in relation to the operating cam, because of the design and anchorage of the cam.

2. SOLUTION

The object of the present invention is to obviate this and other problems, and provide for the cam that is movably disposed in its anchorage such that the movement of the breech block to the arrest position is independent of the position of the breech in the region of total recoil.

According to the present invention the operating cam is movably disposed when the breech is in the region of its total recoil, so that the spring means is capable of commencing to actuate the breech block in its movement towards the arrest position, independently of the configuration of the cam and the position of the breech in that region.

In another embodiment the movably disposed operating cam is arranged so as to cooperate with buffer devices. In one preferred embodiment of the present invention, the mounting for the operating cam is rotatably journalled at its one end and cooperates with the buffer device at its other end.

The mounting for the cam can assume a fixed position in relation to the breech during the first phase of the recoil cycle. When the breech has reached a predetermined point in its recoil, the operating cam mounting is released and is thereafter capable of executing movements which substantially coincide with the direction of movement of the breech block. When the breech has turned and, during its recuperation, has returned to the predetermined point, it is guided by positionally fixing devices disposed on or connected to the breech.

The buffer device works from an initial position which is assumed when the breech block is closed and the weapon is laid. The buffer device cushions the stroke of the operating arm in conjunction with the recoil of the breech. After the cushioning of this type, it should be possible for the buffer device to permit an approximately twice as long stroke as was initiated by the spring member on the operating cam mounting which is freely suspended at the cycle phase in question. The buffer device is of a specific construction so as to be able to cater for these functions.

The positionally fixing device fixes the operating cam mounting by means of cooperation with a lower guiding surface on the mounting. This guiding surface is chamfered, which facilitates guiding of the operating cam mounting.

3. ADVANTAGES

According to the present invention, the feeding and ramming cycle may be commenced in that the breech block may start its movement towards the arrest position earlier than would have been possible using a fixedly mounted operating cam. This provides for a higher rate of fire.

The impact of the breech block against the ejectors in conjunction with the arrest cycle may be cushioned by buffer means, which entails that it will be possible to avoid jolt phenomena on impact of the breech block against the ejectors. The chamfered portion of the guiding surface facilitates guiding of the positionally fixing member when this arrests the operating cam mounting.

BRIEF DESCRIPTION OF THE DRAWINGS

The nature of the present invention and its aspects will be more readily understood from the following brief description of the accompanying Drawings, and discussion relating to significant characteristics of the present invention in one currently proposed embodiment thereof.

In the accompanying Drawings.

DESCRIPTION OF PREFERRED EMBODIMENT

The present invention may be utilized in the 40 mm automatic gun designated L/70 sold by BOFORS. Hence, the gun will not be described in its entirety, only those parts which are pertinent to the description of the present invention being considered here.

Figure 1:
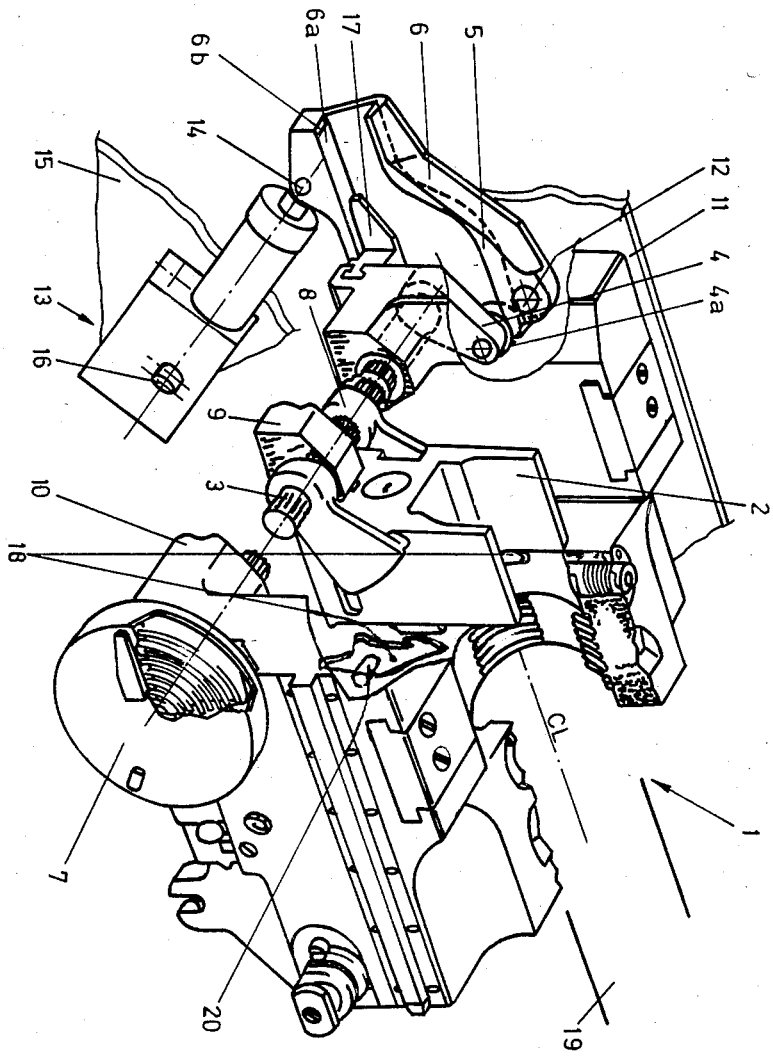
FIG. 1 is an oblique right rear upper perspective view of parts of an automatic gun germane to the apparatus of the present invention.

Referring to FIG. 1 a breech block 2, is showed with associated breech mechanism, disposed in the breech 1 of the weapon. The breech mechanism includes an operating shaft 3 which, at its first end, is provided with an operating arm 4. This latter cooperates with an operating cam 5 on a cam mounting 6. At its other end, the shaft is in cooperation with spring means 7. The shaft is provided with operating linkages 8 and the shaft is journalled in housings 9 and 10 in the breech 1.

The cam mounting 6 for the operating cam is, at its first end, journalled in the casing 11 in a rotary journal which is designated by reference numeral 12. At its other end, the operating cam mounting cooperates with a buffer device 13. The buffer device is journalled to the mounting 6 by the intermediary of a pivoting journal 14, and to the gear arc 15 of the gun by the intermediary of the pivot journal 16. Furthermore, a positionally fixing device for the mounting 6 of the operating cam is designated 17. This device 17 cooperates with the mounting 6 by the intermediary of a guiding surface 6*a* which, at the free end of the mounting 6, includes a chamfer 6*b*. Ejectors are designated 18.

In FIG. 1, the breech block 2 is illustrated in its closed position. A round 19 is assumed to be rammed home and the rear edge of the round lies in engagement with the ejectors 18 in a manner known in the art, such engagement having been dispensed with from the Drawings, for purposes of clarity.

In conjunction with firing of the round, the breech recoils in relation to the operating cam mounting 6 and the buffer device 13. The cam 5 then causes a torque movement to be transmitted to the shaft 3 by the intermediary of the arm 4. This torque is effected against the action of the spring member 7 which, in the present embodiment, consists of a helical spring which is placed under tension on the above-mentioned movement of the shaft. The torque on the shaft also occasions the operating linkages 8 to force the breech block downwardly towards its open position. In this movement of the breech block, the block mechanically acts upon the ejectors so that these are obliged to execute a pivotal movement about their journal 20 and thereby execute their ejection movement, during which the spent case in the barrel is withdrawn and ejected rearwardly.

At a predetermined point in the recoil, the mounting 6 is released from the device 17. The mounting 6 is thereby unrestrained to execute movements about its journal 12 against the action of the buffer device 13. Release of the mounting 6 may be effected approximately halfway along the travel of the recoil.

Figure 2:
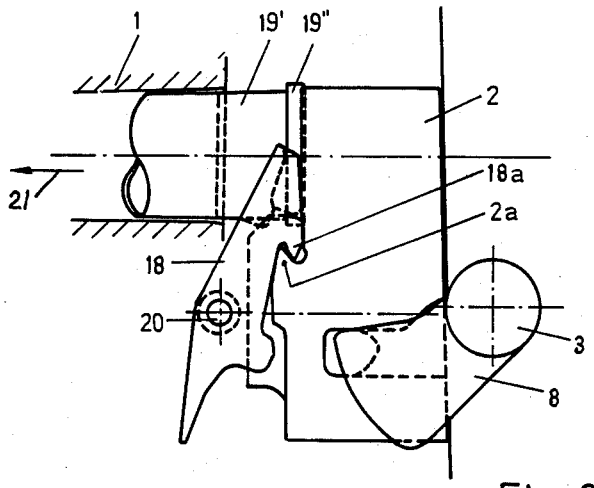
FIG. 2 is a schematic side elevation of the breech block in a first operative position, illustrating its cooperation with ejector and operating linkage.

In the fully recoiled position of the breech, the breech block is to turn and recuperate towards an arrest position according to FIG. 2. The arrest action is catered for by the ejectors which are allocated their arrest position according to FIG. 2 on ejection of the case of the most recently spent round. Each respective ejector 18 is provided with a shoulder 18*a* which is cooperative with a corresponding abutment surface 2*a* on the breech block. The spring member 7 thus holds the breech block 2 tensioned against the ejectors 18 during the recuperation movement of the breech. When the breech has reassumed its initial position according to FIG. 1, a new round 19' is rammed home, which may be effected because the breech block 2 assumes its arrested position. In FIG. 2, the ramming direction is indicated by the arrow 21.

In the arrest position according to FIG. 2, the ejectors are exposed to the rear edge 19'' of the round 19'. A part of the kinetic energy inherent in the round 19' may thus be transmitted to the ejectors 18 which, in such an event, are entrained with the round so that the breech block is released. As soon as the breech block 2 is released, the spring member can actuate the breech block towards its closure position as shown in FIG. 1.

The catch surfaces on the shouldes 2*a* and 18*a* may be provided with undercut surfaces which, in conjunction with the release of the case ejector from the breech block, cause a downward movement of the breech block. This function provides for a predetermined retardation/cushioning of the round 19'.

Figure 2A:
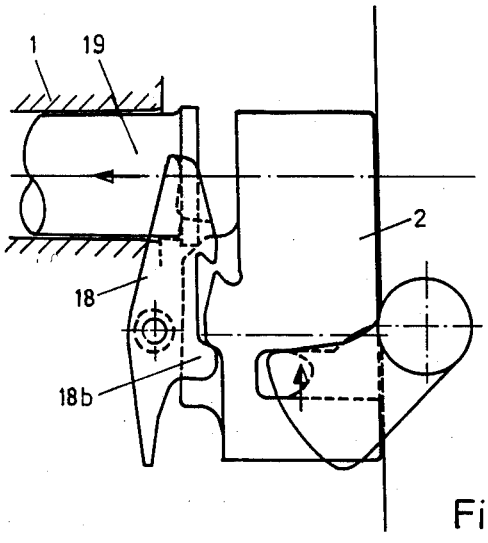
FIG. 2*a* is a schematic side elevation of a second operative position of the breech block, showing its cooperation with ejector and operating linkage.

FIG. 2*a* illustrates the release cycle between the case ejector 18 and the breech block 2. The downward movement of the breech block on the release action occasions impact against an abutment surface 18*b* which results in an upward movement of the breech block and aids in its upward movement, at the same time contributing to the cushioning function in the impetus of the round.

At the end of the recoil, the wheel 4*a* of the arm 4 strikes against the guiding surface 6*a*. This impact is cushoned by the buffer device 13. At the beginning of the recuperation movement from the full recoil position of the breech, the mounting 6—which in this position is freely suspended—is under the action of the spring member 7. Thus, the mounting 6 is urged upwardly at its end 6*a* by the arm 4. This also entails that the breech block may already be actuated towards the arrest position when the breech is in the initial phase of its recuperation movement from the fully recoiled position. This in turn entails that the breech block will not be dependent on the configuration of the cam 5 and the position of the breech in its recuperation movement. This once again allows for the arrest cycle to be completed earlier and ramming of a new round can be commenced correspondingly earlier.

The arm 4 acts against the operating cam at the end 6a of the mounting 6 against the action of the buffer device 13. This is preferably designed such that the abutment of the breech block against the ejectors 18 will be of optimum cycle as regards rapidity, jolts etc.

Figure 3:
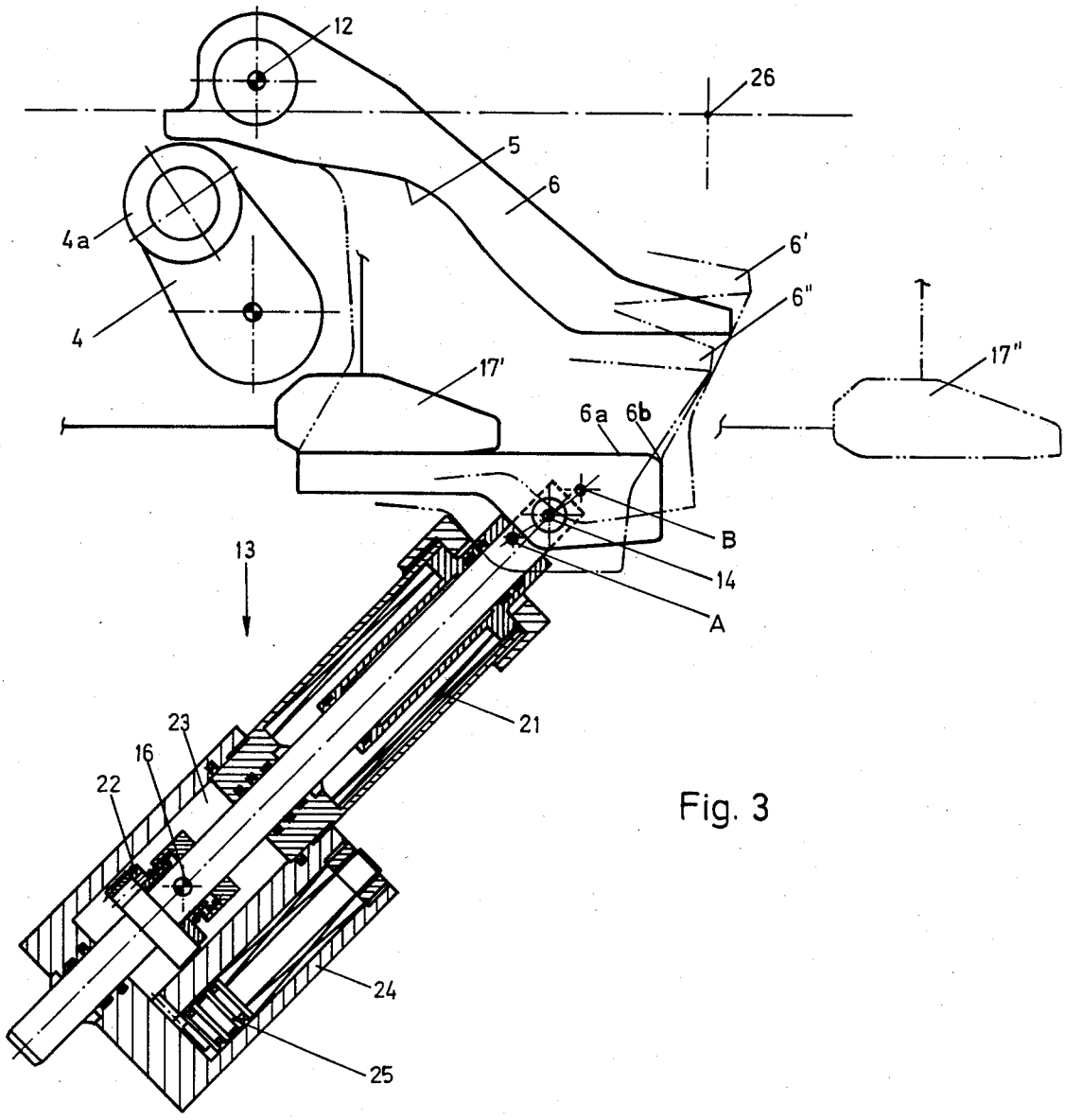
FIG. 3 shows, in side elevation and partial section, parts of the equipment of FIG. 1.

FIG. 3 shows the end positions of the fixation device 17, the position corresponding to that of FIG. 1 being indicated by numeral 17' and the position corresponding to full recoil by numeral 17''. It will be apparent to the skilled in the art from this figure that release takes place once the breech has executed slightly more than half of its recoil movement.

On cushioning of the impact from the arm 4, the shaft 14 is to move to the position A, which, in the present case, corresponds to approximately 10 to 15 mm. Actuation from the arm 4 at the end 6a (see FIG. 1) entails a movement from the point A to the point B of approximately 25 mm. The end positions of the mounting 6 are indicated by 6' and 6''. In order to effectuate the first cushioning movement, the buffer device includes an annular spring 21 which gives a relatively slight cushioning movement and considerable energy absorption. The buffer device also includes hydraulic cushioning by means of the piston 22 in a liquid-filled cavity 23. In this case, the piston includes a non-return valve function, which entails that the piston arrangement does not cushion, or cushions to but a slight degree, the movement to point A, its action being substantially concentrated to cushioning the movement between point A and point B. Such cushioning or buffer arrangements are known in the art and will not, therefore, be described in greater detail here. However, it might be mentioned that the buffer device includes an apparatus 24 which is provided with a piston plunger 25 which accommodates volume changes in the liquid (for example glycol) independently of temperature. In FIG. 3, spindle center has been designated 26.

The present invention should not be considered as restricted to the embodiment described by way of example in the foregoing, many modifications being conceivable without departing from the spirit and scope of the appended Claims and the inventive concept as herein disclosed.

What we claim and desire to secure by Letters Patent is:

1. An apparatus for increasing the rate of fire of an automatic weapon comprising: a breech mechanism controlled by means of recoil movements arising in a breech of the weapon in its discharge, and by an operating cam and a spring member included in the breech mechanism; case ejectors for arresting a breech block in the total recoil position of the breech, and holding said breech block in the open position for the subsequent ramming of a new round, said case ejectors being exposable, in the arrest position of the breech block, to a new round in its ramming cycle, said ejectors accompanying the new round and releasing the breech block to be unrestrained for actuation by said spring member towards its closed position, and said operating cam being movably disposed at least when the breech is in the total recoil position, so that said spring member begins actuation of said breech block in its movement towards the arrest position independently of the configuration of said operating cam and at an earlier stage than total recoil position of the breech, and wherein said operating cam is pivotally journalled at its one end and attached to a buffer device at its other end.

2. The apparatus as claimed in claim 1, further comprising a position fixing member for fixedly positioning a mounting of said operating cam with respect to said breech at the initial phase of the breech recoil.

3. The apparatus as claimed in claim 2 wherein said mounting of said operating cam is provided with a guiding surface which cooperates with said position fixing member; said guiding surface having a chamfered position which facilitates guiding of said position fixing member when the breech executes its recuperation movement from total recoil position.

4. An apparatus for increasing the rate of fire of an automatic weapon comprising: a breech mechanism controlled by means of recoil movements arising in the breech of the weapon on its discharge, and by an operating cam and a spring member included in the breech mechanism; case ejectors for arresting a breech block in the total recoil position of the breech, and holding said breech block in the open position for the subsequent ramming of a new round, said case ejectors being exposable, in the arrest position of the breech block, to a new round in its ramming cycle, said ejectors accompanying the new round and releasing the breech block to be unrestrained for actuation by said spring member towards its closed position, and said operating cam being movably disposed at least when the breech is in the total recoil position, so that said spring member begins actuation of said breech block in its movement towards the arrest position independently of the configuration of the cam and at an earlier stage than total recoil position of the breech, wherein a mounting device of said operating cam is provided with a guiding surface which cooperates with a position fixing member, said guiding surface having a chamfer which facilitates guiding of said position fixing member when the breech executes its recuperation movement from total recoil position.

5. The apparatus as claimed in claim 4 wherein said operating cam is attached to a buffer device.

6. An apparatus as claimed in claim 5 wherein said operating cam is pivotally journalled at its one end and attached to a buffer device at its other end.

* * * * *